United States Patent [19]

Prevignano

[11] Patent Number: 4,688,957

[45] Date of Patent: Aug. 25, 1987

[54] FEEDER FOR OFFICE MACHINES FOR INDIVIDUAL SHEET OR CONTINUOUS FORMS

[75] Inventor: Paolo Prevignano, Albiano d'Ivrea, Italy

[73] Assignee: Ingf. C. Olivetti & C., S.p.A., Ivrea, Italy

[21] Appl. No.: 798,622

[22] Filed: Nov. 15, 1985

[30] Foreign Application Priority Data

Nov. 19, 1984 [IT] Italy ..... 68154 A/84

[51] Int. Cl.[4] ..... B41J 11/50

[52] U.S. Cl. ..... 400/605; 400/613.1; 400/616; 400/625; 400/637.2; 400/647

[58] Field of Search ..... 400/605, 611, 613.2, 400/616, 616.1, 616.2, 618, 624, 625, 629, 636, 637, 637.2, 642, 709, 643, 647, 613.1; 192/48.1, 48.9, 48.91, 51, 67 R; 271/9

[56] References Cited

U.S. PATENT DOCUMENTS

| | | | |
|---|---|---|---|
| 2,302,704 | 11/1942 | Mabon | 400/616.2 |
| 3,158,244 | 11/1964 | Lanigan, Jr. et al. | 192/48.91 |
| 4,360,279 | 11/1982 | Sugiura | 400/618 |
| 4,391,542 | 7/1983 | Baitz | 400/605 |
| 4,417,825 | 11/1983 | Cushman et al. | 400/605 |
| 4,553,623 | 11/1985 | Ohkubo | 192/48.91 |
| 4,572,418 | 2/1986 | Hirata | 400/616.2 |
| 4,606,663 | 8/1986 | Christoph et al. | 400/605 |

FOREIGN PATENT DOCUMENTS

| | | | |
|---|---|---|---|
| 2716396 | 10/1978 | Fed. Rep. of Germany | 400/605 |
| 2912656 | 10/1980 | Fed. Rep. of Germany | 400/605 |
| 38175 | 3/1982 | Japan | 400/616.1 |
| 84884 | 5/1982 | Japan | 400/625 |
| 185670 | 10/1984 | Japan | 400/605 |

*Primary Examiner*—Edgar S. Burr
*Assistant Examiner*—David A. Wiecking
*Attorney, Agent, or Firm*—Banner, Birch, McKie & Beckett

[57] ABSTRACT

The sheet feeder is formed by a separate unit (10) which can be easily mounted spaced from the platen roller (14) on a typewriter (12) or printer of a data processing system. The print carriers comprise either a continuous web (22) or individual sheets (20). The continuous web is advanced by pin wheels (72) and guided towards the platen roller. The individual sheets (20) which are supported on a feed tray (30) are fed one at a time by means of stripper rollers (40) and passed towards the platen roller (14). The printed sheets are passed into a collector tray (60) by means of collector rollers (54, 56). The pin wheels (72) device and the stripper rollers (40) are rotated selectively from the platen roller by way of a mechanical transmission including a clutch which is actuated by a manual control (116) to connect the pin wheels (72) or the stripper rollers (40) alternatively to the platen roller (14). The manual control also moves the paper guide (52) away from the platen for continuous form feed.

1 Claim, 4 Drawing Figures

FEEDER FOR OFFICE MACHINES FOR INDIVIDUAL SHEET OR CONTINUOUS FORMS

BACKGROUND OF THE INVENTION

The present invention relates to a sheet feeder for a typewriter or other office machine with a rotatable platen roller.

In a known arrangement for feeding discrete print sheets to the platen roller, the sheets are removed one at a time by stripper rollers which are rotated from the platen roller by way of a transmission of toothed gear of toothed belt type. That arrangement can only handle individual sheets and is not suitable for advancing continuous webs with edge perforations.

SUMMARY OF THE INVENTION

The object of the present invention is to provide a sheet feeder removably mountable on an office machine and which is capable of selectively handling both individual sheets and continuous webs.

This object is met by the sheet feeder according to the invention which is characterised by advancing means for advancing a continuous print web, the advancing means being connected to the mechanical transmission by way of a clutch actuable for selectively connecting the platen roller to the pick-up means or to the advancing means.

BRIEF DESCRIPTION OF THE DRAWINGS

The invention will be described in more detail, by way of example, and with reference to the accompanying drawings, in which:

FIG. 1 shows a print carrier feeder 10 mounted on a printer 12. The printer 12 may be of any type and comprises a platen roller 14 which is rotated by its own motor (not shown) mounted on the printer.

Figure 2:
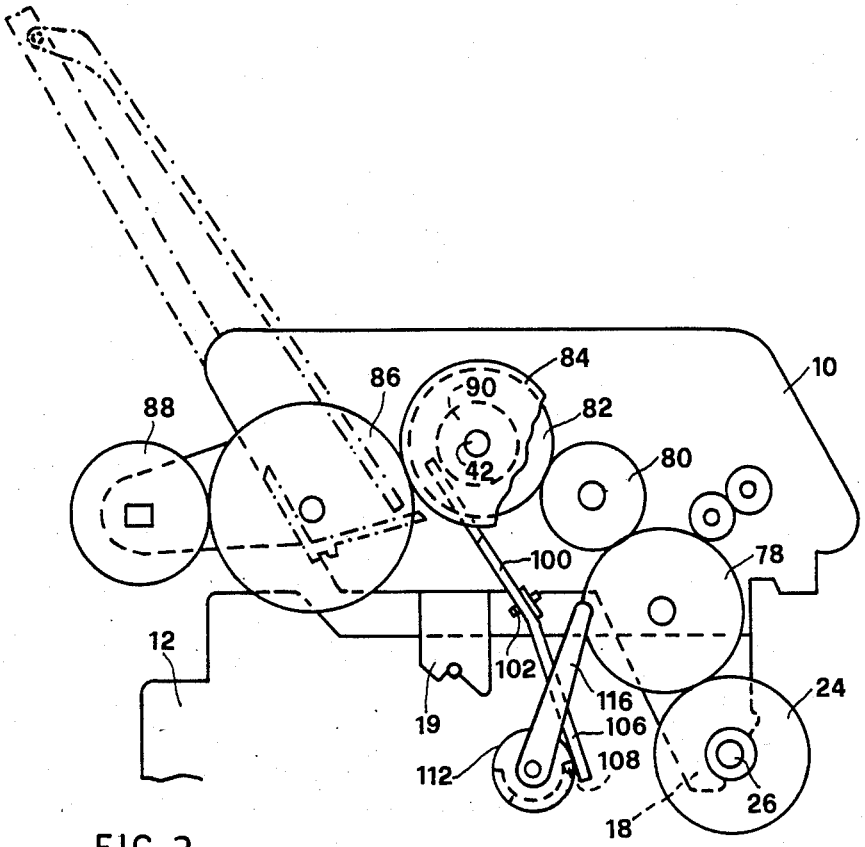
FIG. 2 is a side view of the mechanical transmission of the feeder shown in FIG. 1.

A print head 15 is displaced parallel to the roller 14 to selectively print on sheets 20 or on a web 22 characters or graphic signs which are produced by a logic means of a printing system of which the printer 12 forms part. The feeder 10 may be easily mounted on and removed from the printer 12 by virtue of a double fork-type coupling arrangement 18 and 19 (see FIG. 2).

Figure 4:
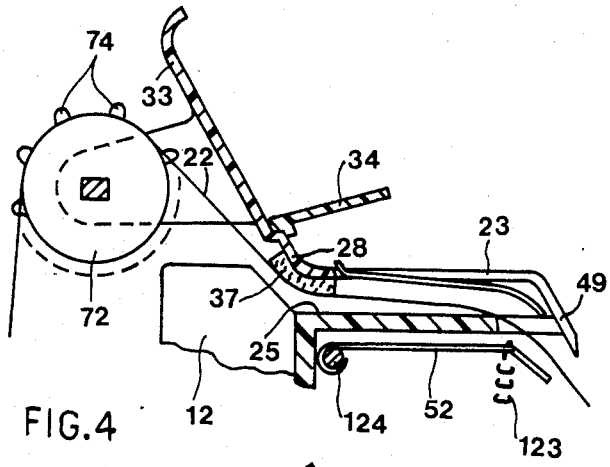
FIG. 4 is a detail of an alternative embodiment of FIG. 1.
Figure 1:
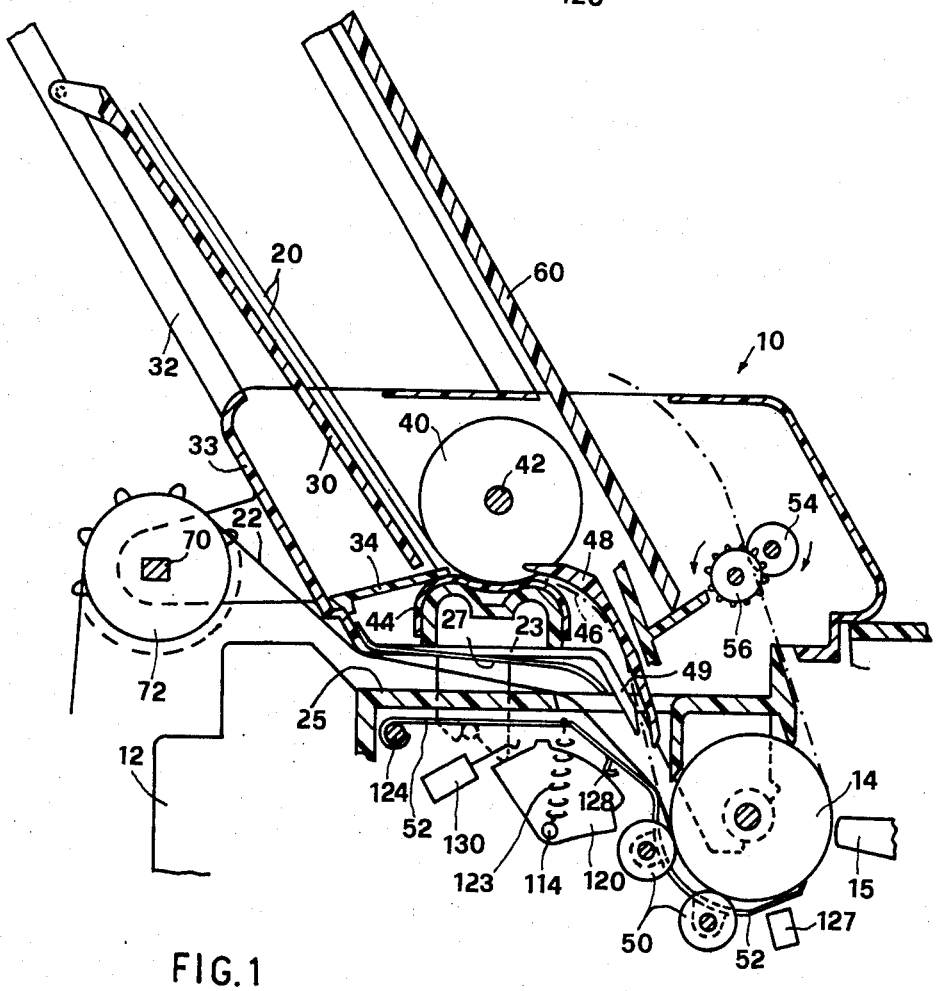
FIG. 1 is a simplified view in vertical cross-section of a print carrier feeder embodying the invention, mounted on a printer.

The feeder 10 is capable of transporting individual sheets 20 (see FIG. 1) or a continuous web 22 towards the platen roller 14 of the printer 12. The feeder 10 is of the passive type in the sense that the members thereof for entraining the print sheet 20 or the web 22 derive their motion from the platen roller 14 of the printer 12 by means of a toothed gear 24 (see FIG. 2) which is keyed on the shaft 26 of the platen roller 14. The individual sheets 20 are supported on a flat tray 30 (see FIG. 1) which is pivotally mounted at the top on a carrier 32 which slopes back at about 30°, being fixed to the body structure 33 of the feeder 10. The head edges of the individual sheets bear against a lower surface 34 which is fixed with respect to the body structure 33. The sheets 20 are withdrawn from the tray 30 one at a time by stripper rollers 40 which are keyed on a shaft 42 which is parallel to the tray 30 and rotatable on the feeder 10. After the operation of stripping a sheet from the stack on the tray 30, a pad member 44 of high-friction material retains any second sheet which has remained clinging to the first sheet removed, in a manner known per se, by virtue of a friction difference. The sheet 20 is then pushed by the rollers 40 along a path 46 defined by guides 48 and 49 towards the platen roller 14 which advances the sheet during the time of printing thereon, in known manner, with the assistance of pressure rollers 50 mounted on a curved tray-like member 52.

When the printing operation is concluded, the sheet 20 is entrained away from the platen roller 14 by collector rollers 54 and 56 and deposited on a collector plate 60. Details of the operation of stripping the sheets from the stack and the way in which the stripper rollers 40 are rotated are known per se and are not described herein for the sake of simplicity.

On the rearward wall of the feeder 10 with respect to the platen roller 14 there rotates a shaft 70 of square cross-section, on which two wheels 72 are mounted. Only one of the wheels 72 is shown in the drawings. The wheels 72 are fitted with pins 74 which entrain the continuous web 22 by means of lateral perforations 122. The continuous web 22 is passed between the lower wall 23 of the feeder 10 and the upper wall of the printer 12. A curved plate 27 which is fixed with respect to the wall 23 guides the web 22 downwardly between the tray-like member 52 and the roller 14, to be taken between the rollers 50 and the platen roller 14.

Figure 3:
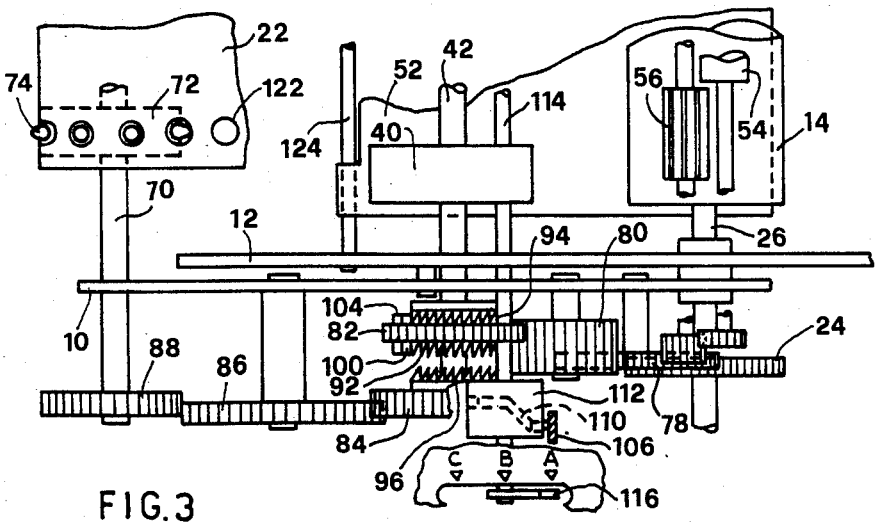
FIG. 3 is a plan view of the mechanical transmission of FIG. 2.

The shaft 70 is rotated by the platen roller 14 by way of a mechanical transmission formed by gears 78–88 which connect the shaft 70 to the shaft 26 of the platen roller 14. The transmission 78–88 further includes a clutch 90 (see FIGS. 2 and 3) which has two positions, for selectively connecting either the shaft 42 or the shaft 70 to the shaft 26. The clutch 90 which is of mechanical type comprises an intermediate member 92 which is provided with two face tooth arrangements and which is freely rotatably mounted on the shaft 42 but which can be displaced axially between a first driven member 94 which is fixed with respect to the shaft 42 of the stripper rollers 40, and a second driven member 96 which is fixed with respect to the gear 84. Both the members 94 and 96 are provided with a face tooth arrangement. The gear 82 is keyed on the movable member 92 which can be moved axially by means of a lever 100 pivotally mounted on a pivot member 102 which is fixed to the printer 12. At an upper end, the lever 100 is provided with a fork 104 which embraces the gear 82 while the lower end 106 is provided with a pin 108 which is engaged in a helicoidal groove 110 in a small barrel member 112. The barrel member 112 is mounted on a shaft 114 which is rotatable on the printer 12 and which is rotated by means of a manually operable lever 116. Mounted on the shaft 114 is a cam 120 for controlling the opening and closing movement of the tray member 52 which is pivotally mounted on a shaft 124 fixed to the printer 12. The cam 120 co-operates, against the force of a spring 123, with a tongue portion 128 on the tray-like member 52 to move it from a closed position in which the rollers 50 press against the platen roller 14 to an open position in which the rollers 50 are spaced from the platen roller 14. The lever 100 may be positioned in three angular positions: in the first position as indicated at A in FIG. 3, the intermediate member 92 of the clutch 90 is engaged with the driven member 94 whereby rotary movement of the platen roller 14 causes rotary movement of the stripper rollers 40 to feed the individual sheets 20 one at a time (see FIG. 1). The cam 120 holds the tray-like member 52 in its closed position. In its second position B, the lever 100 moves the member 92 into engagement with the driven member 96 whereby rotary movement of the roller 14 rotates the pin wheel 72 for advancing the continuous web 22. The cam 120 still holds the tray-like member 52 in its closed condition to permit the web 22 to be gripped between the platen roller 14 and the rollers 50 and advanced beyond the printing region, in front of the head 15, until it is engaged between the rollers 54 and 56 (see FIG. 1). In position B, the cam 120 closes a microswitch 130 to signal that the web 22 is engaged and that the tray-like member 52 is closed.

A photosensor 127 which is disposed on the printer 12 adjacent the rollers 50 is disposed to detect the presence or absence of the web 22, in combination with a signal generated by the logic control means of the printer. Two situations may be distinguished: (a) the sensor 127 does not detect the web 22; the continuous web 22 is then advanced by means of the rotary movement of the platen roller 14 for a predetermined length from the position of the sensor 127, that is to say, until the web 22 comes into engagement between the rollers 54 and 56; (b) the sensor 127 detects the presence of the web 22; the web 22 is moved back, by rotating the roller 14 in the opposite direction, until it passes beyond the sensor 127. At that point, the arrangement is again in situation (a).

After the web 22 has been correctly positioned in the above-described manner, the lever 116 is moved into position C; the clutch 90 remains engaged with the gear 84 but the tray-like member 52 is opened by the cam 120. The microswitch 130 is opened.

With the lever 114 in position C, the web 22 is advanced during normal operation of the printer 12 by means of the pin-type wheel 72 and by the action of the rollers 54 and 56. The rollers 54 and 56 are rotated by the gear 78 (see FIGS. 2 and 3) which is directly coupled to the platen roller 14. The transmission ratio between the platen roller 14 and the rollers 54 and 56 is such that the web 22 is held in a slightly tensioned condition; the web 22 is now no longer advanced by the platen roller 14 and the rollers 50. In the situation where the continuous web 22 is a multipart set, the combined action of the counter-rotating rollers 54 and 56 on the two outside surfaces of the web 22 prevents relative slipping movement as between the first copy sheet and the last copy sheet, caused by the curvature of the web 22 around the platen roller 14. Since the tension produced in the web 22 by the rollers 54 and 56 can damage the lateral perforations 122 engaged with the wheel 72, in order to avoid that disadvantage the continuous web 22 is caused to pass over a pad 37 of material with a high coefficient of friction. The pad 37 is fixed to the body structure 23 of the feeder in the curved region 28 of the lower wall 23 of the feeder, in such a fashion that the web 22 bears against the pad 37 over an arc of about 30°. In that way, the tension applied to the web 22 by the rollers 54 and 56 is transferred on to the pad 37 and thus the perforations 122 in the web 22 are not damaged by the pins 74.

What is claimed is:

1. A paper feeder for a typewriter and other office machines with a rotatable platen roller, comprising:

guiding means for guiding paper sheets from a supply tray to the platen and then to a collector plate, pick-up means mounted on a shaft parallel to said tray for picking up a single sheet from said tray and transporting the sheet to said platen, advancing means for advancing a continuous paper web towards said platen, a mechanical transmission including an actuatable clutch for selectively connecting said mechanical transmission to said pick up means and to said advancing means, said clutch having a movable member, said movable member being displaced axially by a lever connected to a first cam rotatable from a first position in which said movable member is connected to said pick up means, to a second position in which said movable member is connected to said advancing means, the improvement comprising:

a second cam connected to said first cam and cooperating with a movable curved tray-like member extending partially around the platen, to hold said tray-like member close against the platen in said first and second positions and to open said tray-like member when said first and second cams are rotated to a third position located beyond said second position.

* * * * *